United States Patent [19]

Smetaniuk

[11] Patent Number: 4,599,508

[45] Date of Patent: Jul. 8, 1986

[54] CALORIE COUNTER

[75] Inventor: Terrace S. Smetaniuk, Mississauga, Canada

[73] Assignees: Peter Smetaniuk; Mark F. Voyska; Caroline Flanagan, all of Ontario, Canada

[21] Appl. No.: 749,057

[22] Filed: Jun. 26, 1985

[30] Foreign Application Priority Data

Dec. 10, 1984 [CA] Canada ..... 469722

[51] Int. Cl.[4] ..... G06C 27/00

[52] U.S. Cl. ..... 235/116; 235/78 R

[58] Field of Search ..... 235/73, 74, 76–79.5, 235/83, 84, 115, 116, 117 A, 119, 122, 88 R, 128, 78 R; 40/493, 495

[56] References Cited

U.S. PATENT DOCUMENTS

| | | | |
|---|---|---|---|
| 960,946 | 6/1910 | Jones | 116/334 |
| 1,371,371 | 3/1921 | Hinsman | 116/298 |
| 2,150,442 | 3/1939 | Herzog | 434/127 |
| 2,592,106 | 4/1952 | Askeli | 434/404 |
| 2,702,669 | 2/1955 | Hallowell | 235/83 |
| 2,748,514 | 6/1956 | Sulger | 40/495 |
| 2,888,196 | 5/1959 | Welch et al. | 235/78 R |
| 2,904,249 | 9/1959 | Rich | 235/83 |
| 3,092,072 | 6/1963 | Strimel | 116/129 |
| 3,268,168 | 8/1966 | Staller et al. | 235/76 X |
| 3,323,720 | 6/1967 | Carter | 235/128 |
| 3,433,406 | 3/1969 | Carter | 235/128 |
| 3,565,197 | 2/1971 | Carter | 177/230 |
| 3,664,292 | 5/1972 | Sherman | 116/114 |
| 4,048,477 | 9/1977 | Hungerford | 235/88 R |

*Primary Examiner*—Benjamin R. Fuller

*Attorney, Agent, or Firm*—Panitch Schwarze Jacobs & Nadel

[57] ABSTRACT

A calorie counter for persons wishing to control their weight having a housing with a base and a transparent cover rotatably mounted to the base. An opaque partition is located in the housing parallel to the cover and spaced apart therefrom. This partition has three circular calorie counting scales provided thereon. The partition consists of an inner disk having first and second calorie counting scales and an annular disk which is an outward extension of the inner disk. The annular disk is rotatable and protrudes through a side wall of the base at one location. Two line indicators are provided by two transparent disks located between the cover and the annular partition. The first indicator points to the number of calories contained in a food item while the second indicator points to the total number of calories consumed by the user during a set time period. A gear mechanism operated by a thumb wheel operates both of the indicator disks at the same time.

20 Claims, 4 Drawing Figures

CALORIE COUNTER

BACKGROUND OF THE INVENTION

This invention relates to calorie counters and in particular to a counter capable of providing a readout of the number of calories in a single food item consumed and the total number of calories consumed over a period of time.

Medical and nutritional experts and prominent studies have concluded that a sensible and natural way to reduce one's weight is by a mild restriction of a person's calorie intake. The ideal diet is a slight variation, say 500 to 1,000 calories per day, of the individual's regular diet. It is also recommended that adults not consume less than 1,000 calories per day in order to ensure sufficient nutrients are consumed. A caloric restriction of 500 calories per day can result in a fat loss of one pound per week. Once the desired weight is achieved the individual must then adhere to a regular diet with a caloric intake consistent with their achieved weight level. For example a man weighing 150 pounds can maintain this weight on a caloric intake of approximately 2,300 calories per day.

Weight loss by a reduction of caloric intake requires the dieter to keep track of the calories consumed each day. However it is a problem for many persons to keep a record of the number of calories consumed and in particular to have an up to date total after each serving, which total is desirable in order to avoid exceeding the recommended intake. Although a paper and pen could be used for this purpose, sometimes it is not convenient to use these during the course of a meal or at other times. Also mental addition is sometimes less reliable than the use of a mechanical or electronic counter.

A variety of calorie counters have been proposed in the past but as far as the applicant is aware, such counters have not, for one reason or another, come into widespread use. An example of such a counter is the one shown and described in U.S. Pat. No. 2,702,669 issued Feb. 22, 1955 to C. G. Hallowell. This known counter is provided on a stiff, square base card having a central upstanding pivot. A circular dial is mounted at its centre on the pivot for rotation relative to the base card. On the periphery of the circular dial is provided a total calorie intake scale. Overlying this dial is an index card which is also circular and supported at its centre on the pivot. This card is secured from rotation. On top of the index card are four elongated pointers. This known counter is able to indicate at a glance both a record of calorie consumption at each individual meal and a running record of the total calorie consumption during the day. It suffers from several disadvantages including the fact that the several pointers are exposed and could easily be damaged if the counter is not handled with care. Also the counter might be confusing for some people to operate because of the number of independently operable pointers.

A more recent calorie counter is that shown in U.S. Pat. No. 3,323,720 issued June 6, 1967 to W. L. Carter. This device is also able to record the calories consumed each meal and the total for the day. The indicator has a box like housing with a pair of drums mounted therein. An endless belt is entrained over the drums and this belt has marked thereon indicia progressively indicating total calories consumed. A window in the front of the housing provides a means for viewing the indicia on the band. A knob mounted on the side of the housing provides means for moving the band. This known device does not appear to provide any means for the user to check that the correct number of calories has been recorded on the machine for each food item consumed or for each meal as only the running total appears to be displayed. This machine requires that the number of calories in a single food item be added mentally to the last number displayed. The belt is then moved until the number shown through the window corresponds to the new total. If an error is made in the mental calculation, the user is required to repeat all calorie counts for the entire day since the counter is not provided with a last position memory.

U.S. Pat. No. 2,748,514 issued June 5, 1956 to J. F. Sulger discloses a simple mechanical means for recording the total number of calories consumed by an individual. The indicator includes a flat thin circular case in which is rotatably mounted a wheel, a portion of which protrudes beyond the case through a lateral opening. On the wheel is indicia which may be successfully caused to appear behind a window in the case. Again the number of calories in a single food item must be added mentally to the last number displayed and then the wheel is moved until the number shown corresponds to the new total. If an error is made in the mental calculation, the user is required to repeat all calorie counts for the entire day since the counter is not provided with a last position memory.

An object of the present invention is to provide a calorie counter that is simple to use and that provides two or more calorie readouts including the amount recorded for an individual serving and the total number of calories consumed over a period of time, such as the start of the day. Because the calorie counter of the present invention provides a readout of the number of calories recorded for a single serving, errors in recording the number of calories are less likely and, if they can occur, the errors can be quickly corrected before the next item is recorded.

A further object of the invention is to provide a novel calorie counter that can be made at relatively low cost and in a compact configuration.

The preferred embodiment has a third calorie readout indicating the total number of calories remaining to be consumed without exceeding a set calorie intake goal.

With the preferred embodiment which includes a last position memory, errors in recording the number of calories are less likely and, if they occur, the errors can be quickly corrected before or after the next item or meal is recorded.

SUMMARY OF THE INVENTION

According to one aspect of the present invention, a calorie counter comprises a housing having a bottom, a sidewall and a transparent top, and indicia means providing at least first and second calorie counting scales visible from the top of the counter. A first indicator means in the housing indicates on the first scale the amount of calories contained in a single serving of food. A second indicator means in the housing indicates on the second scale the cumulative total of calories consumed by a person over a predetermined period of time. Means are also provided for moving both of the first and second indicators at the same time. The moving means include a set of gears operatively connected to the first and second indicator means.

According to another aspect of the present invention, a calorie counter comprises a housing having a base and a transparent cover rotatably connected to the base. Indicia means are arranged in the base and provide first and second calorie counting scales visible through the cover. A first indicator means in the housing indicates on the first scale the amount of calories contained in a single serving of food. The second indicator means in the housing indicates on the second scale the cumulative total of calories consumed by a person over a predetermined period of time. There are also provided means for moving both of the first and second indicators means at the same time. A third calorie counting scale is arranged on a section of a partition in the housing. At least this section is manually rotatable in the housing in order to set the third scale at a desired position relative to the first and second scales.

The preferred calorie counter disclosed herein can be made quite compact so that it can easily be carried by the user in a pocket or purse. Because most of the moving parts are enclosed or protected by the outer housing, the counter cannot be easily damaged by normal handling. The calorie scales can be made readily visible and arranged in an easily understood manner.

Further features and advantages will become apparent from the following detailed description, taken in conjunction with the accompanying drawings.

DETAILED DESCRIPTION OF PREFERRED EMBODIMENT

Figure 2:
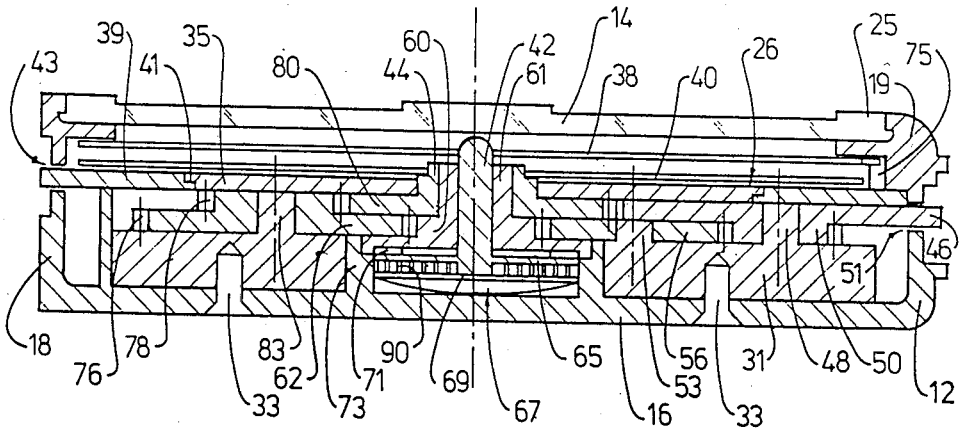
FIG. 2 is a cross-sectional elevation taken along the line II—II of FIG. 1.
Figure 3:
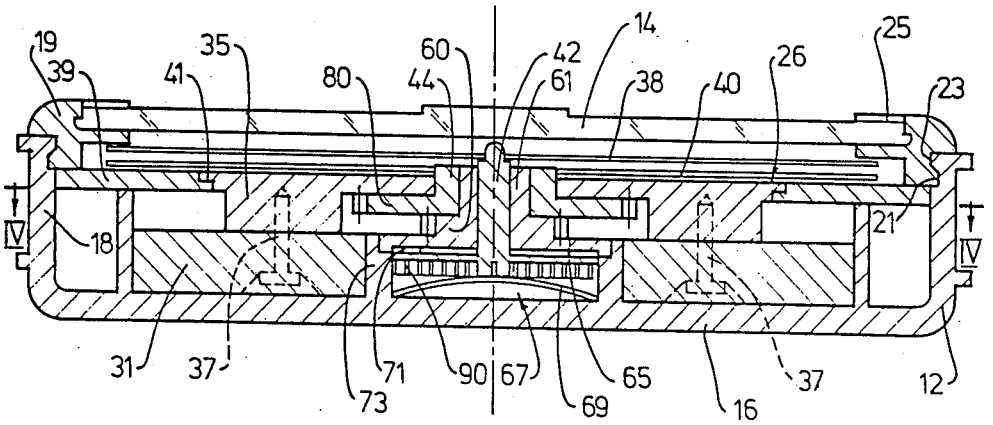
FIG. 3 is a cross-sectional elevation taken along the line III—III of FIG. 1.

A calorie counter 10 constructed in accordance with the present invention comprises a housing having a base 12 and a transparent cover 14 rotatably connected to the top of the base. The base has a flat bottom 16 and an annular side wall 18 and can be made from opaque injection moulded plastic or from a suitable metal. As can be seen from FIGS. 2 and 3, the cover 14 is connected to the top of the side wall 18 by means of an annular member 19. The member 19 is connected by a snap fit between a ridge 21 formed on the annular member and an inwardly projecting rim 23 formed on the top of the side wall. It will be understood that the disk-like cover 14 is rotatable in the annular member 19 and this rotation is assisted by a circle of ridges 25 formed in the top surface of the cover and shown in FIGS. 1 to 3. Painted or otherwise marked on the bottom surface of the cover 14 is a short line 29 that can be used to indicate the last position of an indicator to be described. Finally with respect to the cover 14, it should be noted that the cover should be made of a plastic material that will enable the centre of the cover to be depressed downwardly at its centre for a purpose to be described.

Figure 4:
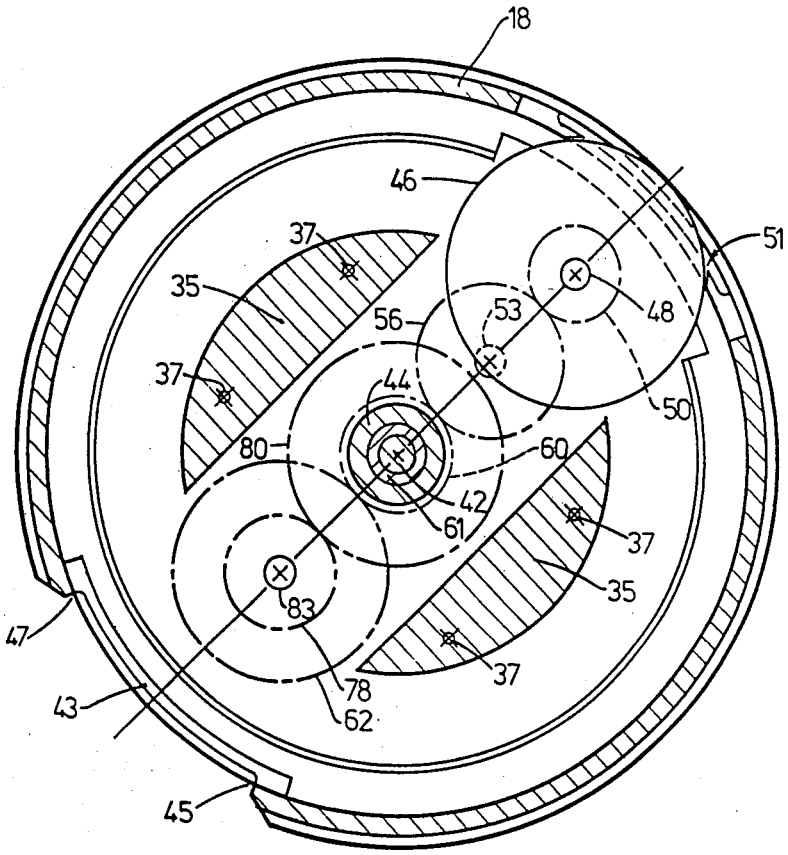
FIG. 4 is a cross-sectional view through the base of the calorie counter along the line IV—IV of FIG. 3.

Inside of the housing is an annular gear-supporting member 31. It is detachably connected to the bottom 16 by a suitable number of screws 33. Resting on top of the member 31 and supported thereby is an opaque circular partition 26 which is divided into two sections. The first section is a circular disk 35 which has a hole in its centre and is fixedly connected to the supporting member 31 by suitable screws located at 37. The second section is an annular disk 39 which can be rotated about the centre of the disk 35. The two disks are provided with overlapping edges at 41 so that the annular disk 39 will be held in position by the disk 35 and be guided thereby. An outer edge portion of the annular disk 39 projects through a slot 43 formed in the side wall 18 and extending between the points 45 and 47 indicated in FIGS. 1 and 4. It will thus be seen that the annular disk 39 can be rotated with a finger or thumb in order to set the position of a calorie counting scale 34 marked on the top thereof. Use of the scale will be described further hereinafter.

Figure 1:
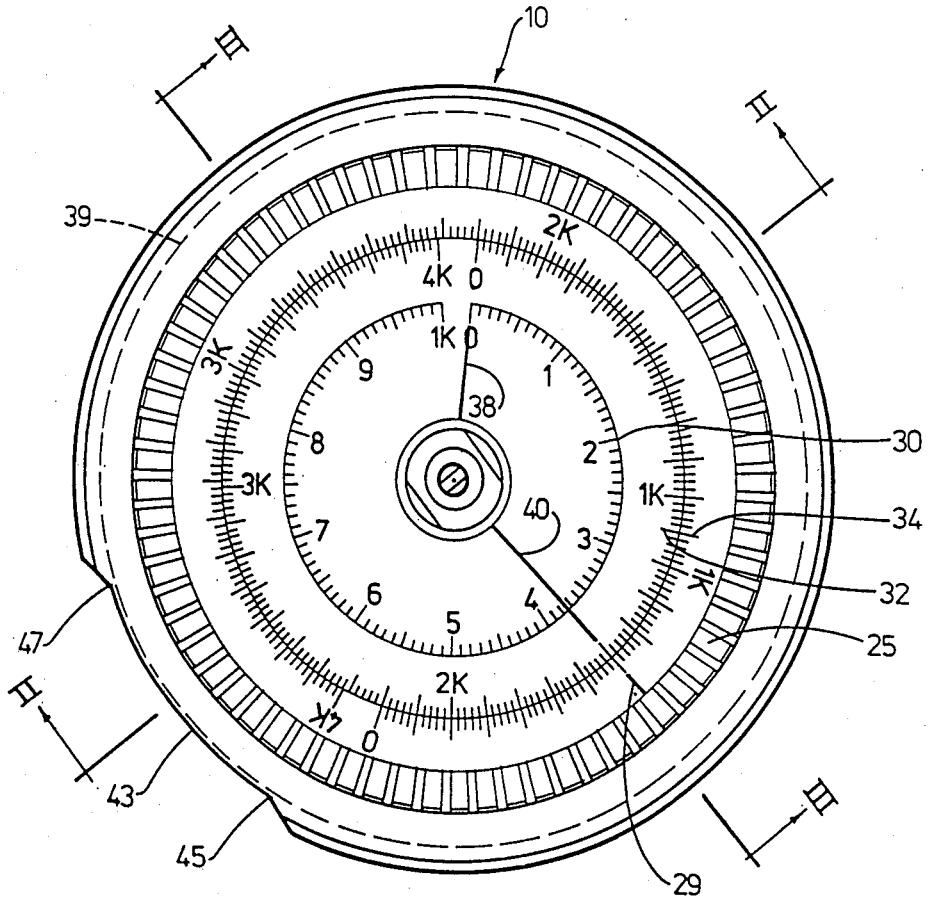
FIG. 1 is a top view of a calorie counter constructed in accordance with the invention.

Arranged on the top surface of the circular disk 35 are two calorie counting scales indicated at 30 and 32 in FIG. 1. The first scale 30 is substantially circular and marked off from 0 to 1000 (1K) calories. Thus each unit on this scale running from 0 to 10 represents 100 calories. The scale 30 is used to indicate or record the amount of calories contained in a food item or single serving consumed by the consumer.

The second calorie counting scale 32 is also substantially circular and is arranged around the outside of the scale 30. The scale 32 is marked off in units of 1000 calories (1K) calories and ranges from 0 to 4,000 calories. The second scale is used to indicate the cumulative total of calories consumed by the user over a predetermined period of time, usually since the beginning of the day.

Located in the space between the cover 14 and the partition 26 are first and second indicator means 38 and 40. In the illustrated preferred embodiment, each of these indicator means is provided by a relatively thin transparent, rotatable disk having a radially extending line marked thereon. These lines or pointers are shown in FIG. 1 with the line on the disk 38 being shorter than the line on disk 40. The longer line on disk 40 is used in conjunction with the scale 32 to indicate the total amount of calories consumed by the user over a period of time, usually the beginning of the day. The shorter line on the disk 38 is used in conjunction with the scale 30 to indicate the amount of calories contained in a food item. Preferably each of these lines is marked or stamped on the underside of the transparent disk. The disk 38 is rigidly connected to a central vertical shaft or pin 42 which extends through the partition 26 to a point immediately below the centre of the cover 14. The transparent disk 40 is rigidly connected to a sleeve 44 which extends about the pin 42 and through the partition 26.

Means are provided for moving both of the first and second indicator means 38 and 40 at the same time. The moving means includes a set of gears operatively connected to the first and second indicator means. A manually operated device or wheel 46 is mounted in the housing on a stub shaft 48 which projects upwardly from the supporting member 31. The wheel 46 has an edge portion projecting from one side of the housing through a slot 51. The wheel 46 is preferably knurled or roughened at the edge to permit rotation easily by means of a thumb or finger. A gear 50 is formed on one side of the wheel 46. The gear 50 engages a larger gear 56, the size of which can be seen from FIG. 4. The gear 56 rotates about a stub shaft 53 which extends upwardly from the supporting member 31 and is an integral part thereof. The teeth of gear 56 engage the teeth of a centrally located gear 60 through which the shaft 42 extends. The aforementioned sleeve 44 is supported by a shoulder formed on the centre gear 60. Also the centre gear 60 has an upward extension 61 about which the sleeve 44 is rotatably mounted. The teeth of the centre gear 60 engage another large gear 62 rotatably mounted on a stub shaft 83 that extends upwardly from the supporting member 31. In addition to teeth 76 formed on the outermost perimeter of the gear 62, there are teeth 78 formed on a smaller diameter upper portion of the gear. The teeth 78 engage another gear 80 which is an integral part of the aforementioned sleeve 44.

It will be readily seen that turning of the wheel 46 to record the amount of calories consumed will turn both of the indicator means 38 and 40 in normal use. With the line on indicator 38 set at zero on the scale 30, the user turns the wheel 46 when he is about to or has consumed a food item in order to record on the scale 30 the number of calories in that item. When the number of calories is shown on the scale 30, the long line on the indicator means 40 will have advanced the same number of calories along its scale 32. Thus a cumulative total will be provided by the line on the indicator means 40. After the serving has been recorded, the line on indicator 38 is then returned to the zero point on the scale 30.

The present calorie counter 10 provides means for returning the first indicator means 38 to the zero point without affecting the position of the second indicator means 40. The returning means includes a clutch mechanism indicated generally at 67 and a spring return means 90 arranged at the bottom end of the centre shaft 42. The clutch mechanism includes a circular flange 65 integrally formed on the central shaft 42 near the bottom end thereof. This flange substantially covers a circular chamber 67 integrally formed on the bottom of the housing. The flange together with the central shaft 42 are biased upwardly by a standard wavy spring washer 69 that is contained in the chamber 67 and held in position thereby. In the absence of a downward force on the central shaft 42, the flange 65 rests against an annular flat rubber member 71 which forms part of the clutch mechanism. In the preferred embodiment shown, the spring return means 90 comprises a coil spring, the inner end of which is connected to the bottom end of shaft 42. The outer end of the spring is connected at a suitable location to the circular wall 73 that forms the aforementioned chamber 67. It will be readily seen that downward pressure on the centre of the cover 14 will cause the central shaft 42 to be shifted axially downwards, resulting in the flange 65 being disengaged from contact with the rubber member 71. This immediately permits the central shaft 42 to rotate relative to the central gear and thus the spring return means 90 will act to rotate the shaft about its central axis until the first indicator means 38 is returned to the zero point on the scale 30. The first indicator means cannot be rotated past the zero point because of a suitable stop 75 formed on the annular member 19. The generally circular indicator means 38 can be formed with a radially outwardly extending projection on its perimeter to engage the stop 75.

With reference to the aforementioned third calorie counting scale 34 printed or otherwise marked on the partition 26, as shown in FIG. 1 the scale is substantially circular and is arranged immediately adjacent to the scale 32. The scale 34 is marked off in units of 1,000 (1K) calories and ranges from 0 to 4,000 calories. The readings on the scale 34 however go upwards in a counterclockwise direction. It will thus be seen that with the use of the scale 34, the second indicator means can be used to point to total number of calories which remain to be consumed during the remainder of the day without exceeding a predetermined limit or set goal. The third scale is operated by setting the zero point on the scale at the reading on the second scale 32 corresponding to the maximum daily intake.

It will be appreciated by those skilled in the art that various modifications and changes could be made to the illustrated and described calorie counter without departing from the spirit and scope of this invention and all such modifications and changes as fall within the scope of the appended claims are intended to be covered thereby.

What I claim as my invention is:

1. A calorie counter comprising a housing having a base and a transparent cover connected to said base, inner partition means located in said housing parallel to said cover and spaced apart from said cover, said inner partition means having at least two calorie counting scales provided thereon, a first indicator means located between said cover and said inner partition for indicating on one of said scales the amount of calories contained in a food item consumed by the user of the counter;

second indicator means located between said cover and said inner partition means for indicating on the other of said scales the total amount of calories consumed by the user over a predetermined period of time, gear means for operating both of said first and second indicator means at the same time, a manually operated device mounted in said housing for turning and operating said gear means, and means for returning said first indicator means to a zero point on said one of said two scales without affecting the position of said second indicator means.

2. A calorie counter according to claim 1 wherein said transparent cover is rotatable relative to said base and has a last position indicator arranged thereon whereby said last position indicator can be rotated to an existing reading on said other scale before the amount of calories for another food item is recorded.

3. A calorie counter according to claim 1 wherein said inner partition means comprises a first inner section and a second outer section rotatable about said first section and wherein two calorie counting scales extend about said first section and a third calorie counting scale extends about said second section.

4. A calorie counter according to claim 1 wherein said returning means comprise a clutch mechanism formed in part on a central vertical shaft, on which said first indicator means is mounted, and a spring return means capable of returning said first indicator means to said zero point when said shaft is shifted axially downwards.

5. A calorie counter according to claim 1 wherein said first and second indicator means comprise two round, substantially transparent disks, each with an indicator marked thereon to provide a reading on a respective one of the scales.

6. A calorie counter according to claim 1 wherein said manually operated device is a wheel having an edge portion projecting from one side of said housing, a gear formed on one side of said wheel forming part of said gear means.

7. A calorie counter according to claim 3 wherein said clutch mechanism includes an annular flat rubber member mounted on a centrally located gear member and further includes a circular flange integrally formed on said central shaft near the bottom thereof and wherein the central shaft can be shifted axially downwards to disengage said flange from contact with said rubber member.

8. A calorie counter according to claim 7 wherein said central shaft extends through said partition means and the top end of said shaft is directly below the centre of said cover whereby finger pressure on the centre of said cover is capable of shifting said shaft downwards and said first indicator means comprises a round, substantially transparent disk rigidly connected at one end to said shaft.

9. A calorie counter according to claim 8 wherein said second indicator means is a round, substantially transparent disk which is rigidly connected to a sleeve through which said shaft extends, said sleeve being an integral extension of a gear forming part of said gear means.

10. A calorie counter comprising a housing having a bottom, sidewall, a transparent top, and an inner partition spaced away from said top, indicia means arranged on said partition and providing at least first and second calorie counting scales visible from the top of said counter, first indicator means in said housing for indicating on said first scale the amount of calories contained in a single serving of food, second indicator means in said housing for indicating on said second scale the cumulative total of calories consumed by a person over a predetermined period of time, and means for moving both of said first and second indicator means at the same time, said moving means including a set of gears operatively connected to said first and second indicator means.

11. A calorie counter according to claim 10 including spring means for returning said first indicator means to a zero point on said first scale upon disengagement of a clutch mechanism.

12. A calorie counter according to claim 11 wherein said transparent top is provided by a separate cover member that is rotatable relative to said bottom and sidewall and has a last position indicator arranged thereon and wherein said last position indicator can be rotated to an existing reading on said second scale before the amount of calories for another food item is recorded.

13. A calorie counter according to claim 11, wherein said partition is disposed parallel to the bottom and top of said housing and said indicia means is arranged thereon in concentric circles around the centre of said partition.

14. A calorie counter according to claim 11 wherein said set of gears is operated by a rotatable wheel having an edge portion projecting from one side of said housing, a gear formed on one side of said wheel being one of said set of gears.

15. A calorie counter according to claim 11 including a central vertical shaft to which said first indicator means is fixedly connected and a circular flange integrally formed on said central shaft and forming part of said clutch mechanism and wherein said spring means is a coil spring arranged around the bottom end of said shaft and connected thereto.

16. A calorie counter according to claim 11 including a central vertical shaft to which said first indicator means is fixedly connected and a circular flange integrally formed on said central shaft and forming part of said clutch mechanism and wherein said set of gears includes a centrally located gear member having an annular rubber disk mounted on the bottom thereof, said rubber disk forming another part of said clutch mechanism.

17. A calorie counter comprising a housing having a base and a transparent cover rotatably connected to said base, a partition located in said base and spaced apart from said cover, indicia means arranged on said partition and providing first and second calorie counting scales visible through said cover, first indicator means in said housing for indicating on said first scale the amount of calories contained in a single serving of food, second indicator means in said housing for indicating on said second scale the cumulative total of calories consumed by a person over a predetermined period of time, means for moving both of said first and second indicator means at the same time, and a third calorie counting scale arranged on a section of said partition in said housing, at least said section being manually rotatable in said housing in order to set said third scale at a desired position relative to said first and second scales.

18. A calorie counter according to claim 17 wherein said moving means includes a rotatable wheel, an edge portion of which projects from one side of said housing, and a set of gears driven by manual rotation of said wheel.

19. A calorie counter according to claim 18 wherein said cover is flexed inwardly at the centre thereof to return said first indicator means to a zero point on said first scale.

20. A calorie counting scale according to claim 17 wherein said first, second, and third calorie counting scales are all provided on said partition which is divided into a fixed inner section and said rotatable section which is located radially outwardly from the inner section and wherein said first and second calorie counting scales are arranged on said inner section.

* * * * *